US008505616B2

(12) United States Patent
Behrens et al.

(10) Patent No.: US 8,505,616 B2
(45) Date of Patent: Aug. 13, 2013

(54) HYBRID CERAMIC CORE COLD PLATE

(75) Inventors: William W. Behrens, St. Louis, MO (US); Andrew R. Tucker, Glendale, MO (US)

(73) Assignee: The Boeing Company, Chicago, IL (US)

( * ) Notice: Subject to any disclaimer, the term of this patent is extended or adjusted under 35 U.S.C. 154(b) by 883 days.

(21) Appl. No.: 11/640,058

(22) Filed: Dec. 15, 2006

(65) Prior Publication Data

US 2007/0246191 A1 Oct. 25, 2007

Related U.S. Application Data

(63) Continuation-in-part of application No. 11/407,438, filed on Apr. 20, 2006, now Pat. No. 7,905,275.

(51) Int. Cl.
*F28F 7/02* (2006.01)

(52) U.S. Cl.
USPC ..... 165/80.4; 165/80.5; 361/699

(58) Field of Classification Search
USPC ..... 165/80.4, 80.5; 361/699
See application file for complete search history.

(56) References Cited

U.S. PATENT DOCUMENTS 3,307,616 A * 3/1967 Giger ..... 165/134.1
3,452,553 A * 7/1969 Dershin et al. ..... 165/60
3,880,969 A * 4/1975 Latos ..... 264/44
4,884,168 A 11/1989 August et al.
4,884,169 A * 11/1989 Cutchaw ..... 361/700
5,388,635 A 2/1995 Gruber et al.
5,978,220 A * 11/1999 Frey et al. ..... 361/699
6,478,082 B1 11/2002 Li et al.
6,958,912 B2 * 10/2005 Pokharna et al. ..... 361/700
7,044,199 B2 * 5/2006 Thayer et al. ..... 165/80.4
7,275,720 B2 10/2007 Behrens et al.
7,501,111 B2 3/2009 Keller et al.

(Continued)

FOREIGN PATENT DOCUMENTS

EP 12 63040 12/2002
EP 1263040 A 12/2002

(Continued)

OTHER PUBLICATIONS

Examination Report under Section 18(3) for Application No. GB0706419.9, dated Jun. 9, 2008.

(Continued)

*Primary Examiner* — Teresa Walberg
(74) *Attorney, Agent, or Firm* — Toler Law Group, P.C.

(57) ABSTRACT

An exemplary cold plate housing defines an inlet port and an outlet port. A plurality of foam strip assemblies are disposed in the housing. The foam strip assemblies are arranged within the housing so coolant is flowable through a width of the foam strips. Each foam strip assembly includes at least first and second foam strip members each suitably having pore size of no more than around 50 micrometers and porosity of at least around 80 percent, and a first spacer member is interposed between the first and second foam strip members. Each of the foam strip assemblies may include a second spacer member interposed between the first spacer member and one of the first and second foam strip members. The spacer member may include a high thermal conductivity material, such as a metal like copper or aluminum, or a low thermal conductivity material such as a polymer or plastic.

20 Claims, 16 Drawing Sheets

(56) References Cited

U.S. PATENT DOCUMENTS

| | | | | |
|---|---|---|---|---|
| 7,710,722 | B2 | 5/2010 | Suzuki et al. | |
| 2004/0104022 | A1 * | 6/2004 | Kenny et al. | 165/299 |
| 2004/0132607 | A1 | 7/2004 | Wood et al. | |
| 2004/0182548 | A1 | 9/2004 | Lovette et al. | |
| 2004/0245373 | A1 * | 12/2004 | Behrens et al. | 244/10 |
| 2005/0269061 | A1 * | 12/2005 | Brewer et al. | 165/80.4 |
| 2006/0068205 | A1 * | 3/2006 | Potier | 428/408 |
| 2006/0141413 | A1 | 6/2006 | Masten et al. | |
| 2006/0157225 | A1 * | 7/2006 | Martin et al. | 165/80.4 |
| 2007/0095507 | A1 * | 5/2007 | Henderson et al. | 165/104.26 |
| 2007/0246191 | A1 | 10/2007 | Behrens et al. | |
| 2007/0247812 | A1 | 10/2007 | Behrens et al. | |

FOREIGN PATENT DOCUMENTS

| | | | |
|---|---|---|---|
| GB | 2 437 383 | | 12/2008 |
| WO | 99 52838 | | 10/1999 |
| WO | WO 99/52838 | * | 10/1999 |
| WO | 99 66279 | | 12/1999 |
| WO | WO 99/66279 | * | 12/1999 |
| WO | 2004 108531 | | 12/2004 |
| WO | 2004/108531 A1 | | 12/2004 |

OTHER PUBLICATIONS

Haack, David et al, "Novel Lightweight Metal Foam Heat Exchangers," pp. 1-7, Nov. 2001, University of Cambridge, Cambridge, UK.

IEEE Transactions on Components and Packaging Technologies, vol. 26, No. 1, Mar. 2003, "Thermal Performance of Aluminum-Foam Heat Sinks by Forced Air Cooling", Kim et al., pp. 262-267.

Examination Report under Section 18(3) for Application No: GB0706419.9, dated Jun. 9, 2008, UK Intellectual Property Office.

David P. Haack, Kenneth R. Butcher, T. Kim and T. J. Lu; Novel Lightweight Metal Foam Heat Exchangers, pp. 1-7, University of Cambridge; Cambridge, UK; Nov. 2001.

"rarefied", definition from Oxford English Dictionary Online, Oxford University Press, 2009.

"rarefaction", definition from Oxford English Dictionary Online, Oxford University Press, 2009.

IEEE Transactions of Components and Packaging Technologies, vol. 26, No. 1, Mar. 2003, "Thermal Performance of Aluminum-Foam Heat Sinks by Forced Air Cooling", Kim et al.

* cited by examiner

HYBRID CERAMIC CORE COLD PLATE

CROSS-REFERENCE TO RELATED APPLICATIONS

This Application is a Continuation-in-part of application Ser. No. 11/407,438 filed on Apr. 20, 2006, now issued as U.S. Pat. No. 7,905,275.

BACKGROUND

Integrated circuit chips, such as micro-processor chips, and other electronic components generate heat during operation. These components are generally mounted on printed circuit boards (PCBs). To help ensure proper operation, these components generally are kept at an operating temperature below around 160° F. This means that cooling of some sort must be provided for proper operation of electronic components.

Cold plates are widely used for cooling PCBs where the coolant must be kept separated from the electronic components. A cold plate generally consists of an enhanced heat transfer surface encapsulated in a high aspect ratio rectangular duct. The enhanced heat transfer surfaces are typically some sort of fin arrangement or an open-celled, porous metal foam. Coolant flows through the cold plate from one end to the other end, completely wetting the enhanced heat transfer surface inside. This system cools PCBs mounted to the sides of the cold plate. Finned core stocks and metal foams are used in cold plates because they increase the thermal effectiveness by increasing the surface area available for transferring heat to the coolant. However, surface area densities for finned core stock and metal foams are generally limited to approximately 1000 $ft^2/ft^3$. This is chiefly because surface area densities significantly larger than this value result in unacceptably high pressure drop as the coolant flow through the cold plate. High pressure drop translates into a system penalty in the form of higher power required for pushing the coolant through the cold plate. Furthermore, manufacturing fin and metal foam arrangements with higher surface area densities becomes increasingly costly and complex. These limitations on surface area density ultimately limit the heat that can be absorbed for given coolant flowrate. Such a limitation will be exacerbated by introduction in the future of high power electronics because conventional air cooled cold plates will not be able to address cooling of future high power electronics. This is because these chips are projected to generate significantly more heat than contemporary chips while still having an operating temperature limit of around 160° F.

One of several possible applications for cold plates includes cooling PCBs found in avionics units on aircraft. Avionics cooling on aircraft is commonly provided by blowing cooled, conditioned air through cold plate heat sinks. However, generation of this cooling air by an aircraft environmental control system (ECS) constitutes a system performance penalty for the aircraft. This is because the ECS generates cooling air by extracting air from the aircraft's engine and cooling it with ram air ducted into the vehicle from outside. Extracting air from the engine reduces the air available for generating thrust while capturing ram air increases aircraft drag. These effects ultimately reduce range and/or payload for an aircraft.

Therefore, it would be desirable to reduce the amount of air required to cool avionics, thereby reducing the system performance penalty for an air vehicle by increasing vehicle thrust and/or lowering fuel consumption. It would also be desirable to address cooling of future high power electronics that are projected to generate significantly more heat than contemporary chips while still having an operating temperature limit of around 160° F. It would also be desirable to maximize thermal performance of a cold plate while mitigating change in pressure drop across the cold plate.

The foregoing examples of related art and limitations associated therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems and methods which are meant to be exemplary and illustrative, not limiting in scope. In various embodiments, one or more of the problems described above in the Background have been reduced or eliminated, while other embodiments are directed to other improvements.

In an exemplary cold plate, a housing defines an inlet port and an outlet port, and a plurality of foam strip assemblies are disposed in the housing. The foam strip assemblies are arranged within the housing so coolant is flowable through a width of the foam strips. Each foam strip assembly includes at least first and second foam strip members each suitably having pore size of no more than around 50 micrometers and porosity of at least around 80 percent, and a first spacer member is interposed between the first and second foam strip members.

According to an aspect, each of the foam strip assemblies may include a second spacer member interposed between the first spacer member and one of the first and second foam strip members.

According to another aspect, the spacer member may be made of a thermally conductive material, such as a metal like copper or aluminum, or a polymer or a plastic.

In another exemplary cold plate, a housing defines first and second inlet ports and first and second outlet ports, and first and second pluralities of foam strip assemblies are disposed in the housing. Each foam strip assembly includes at least first and second foam strip members each suitably having pore size of no more than around 50 micrometers and porosity of at least around 80 percent, and a first spacer member is interposed between the first and second foam strip members. The first and second pluralities of foam strip assemblies are arranged within the housing such that coolant from the first inlet is flowable through widths of the foam strip assemblies in the first plurality of foam strip assemblies and coolant from the second inlet is flowable through widths of the foam strip assemblies in the second plurality of foam strip assemblies. Flows from the first and second pluralities of foam strip assemblies meet in mid-plane of the cold plate, split, and exit out the first and second outlet ports.

In an advantageous application of an exemplary cold plate, a heat exchanger includes a heat exchanger housing that defines at least one heat exchanger inlet port for a first fluid and at least one heat exchanger outlet port for the first fluid. At least one exemplary cold plate is disposed within the heat exchanger housing intermediate the heat exchanger inlet port and the heat exchanger outlet port such that the first fluid flows over one surface of the cold plate and then an opposite surface of the cold plate. The exemplary cold plate includes a cold plate housing defining at least a first cold plate inlet port for a second fluid and at least a first cold plate outlet port for the second fluid, and at least a first plurality of foam strip assemblies disposed in the cold plate housing. Each foam strip assembly includes at least first and second foam strip members each suitably having pore size of no more than around 50 micrometers and porosity of at least around 80 percent, and a first spacer member is interposed between the first and second foam strip members. The foam strip assemblies are arranged within the cold plate housing such that the second fluid is flowable through a width of the foam strip assemblies.

In addition to the exemplary embodiments and aspects described above, further embodiments and aspects will become apparent by reference to the drawings and by study of the following detailed description.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

DETAILED DESCRIPTION

Figure 1A:
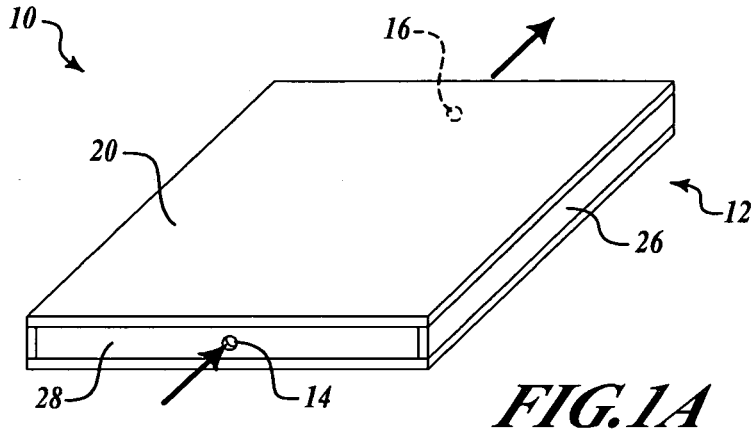
FIG. 1A is a perspective view of an exemplary ceramic foam cold plate.
Figure 1B:
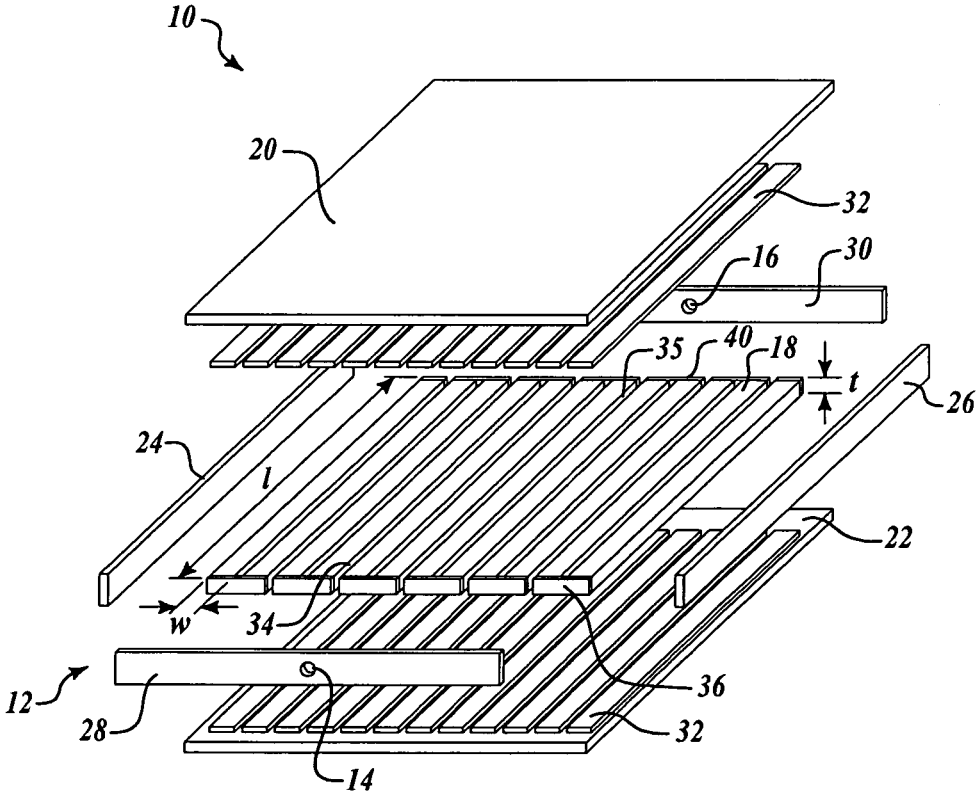
FIG. 1B is an exploded perspective view of the exemplary ceramic foam cold plate of FIG. 1A.

By way of overview and referring to FIGS. 1A and 1B, in an exemplary cold plate 10, a housing 12 defines an inlet port 14 and an outlet port 16, and a plurality of foam strips 18 are disposed in the housing 12. Each of the foam strips 18 suitably has a pore size of no more than around 50 micrometers and a porosity of at least around 80 percent. The plurality of foam strips 18 is arranged within the housing 12 such that coolant flows through a width w of the foam strips 18. Details of exemplary embodiments and applications will be set forth below.

Still referring to FIGS. 1A and 1B, the housing 12 is made of top and bottom cover plates 20 and 22, side plates 24 and 26, and end plates 28 and 30. The end plate 28 defines the inlet port 14 for receiving the coolant, such as cooling air, from a source (not shown) of the coolant. In an exemplary application, the source of cooling air suitably is an aircraft ECS. The end plate 30 defines the outlet port 16 for discharging the coolant from the cold plate 10. Given by way of non-limiting example, in an exemplary embodiment the housing 12 is made of aluminum. However, the housing 12 suitably is made of any lightweight material with acceptable heat transfer properties as desired for a particular application. Other examples of materials from which housing 12 could be constructed include copper, silicon, or a polymer.

In an exemplary embodiment, a thermal sealant 32 is interposed in physical contact between the top cover plate 20 and the foam strips 18 and between the bottom cover plate 22 and the foam strips 18. The thermal sealant 32 physically connects the foam strips 18 to the top cover plate 20 and bottom cover plate 22. The thermal sealant 32 ensures all coolant flows through the foam strips 18 rather than between the top cover plate 20 and the foam strips 18 and the bottom cover plate 22 and the foam strips 18. Given by way of non-limiting example, in one exemplary embodiment the thermal sealant 32 is a room temperature vulcanizing (RTV) silicone. However, the thermal sealant 32 suitably may be any thermal sealant with thermal conductivity characteristics that are acceptable for a particular application as desired. Another non-limiting example of thermal sealant 32 is a conductive epoxy.

Figure 1C:
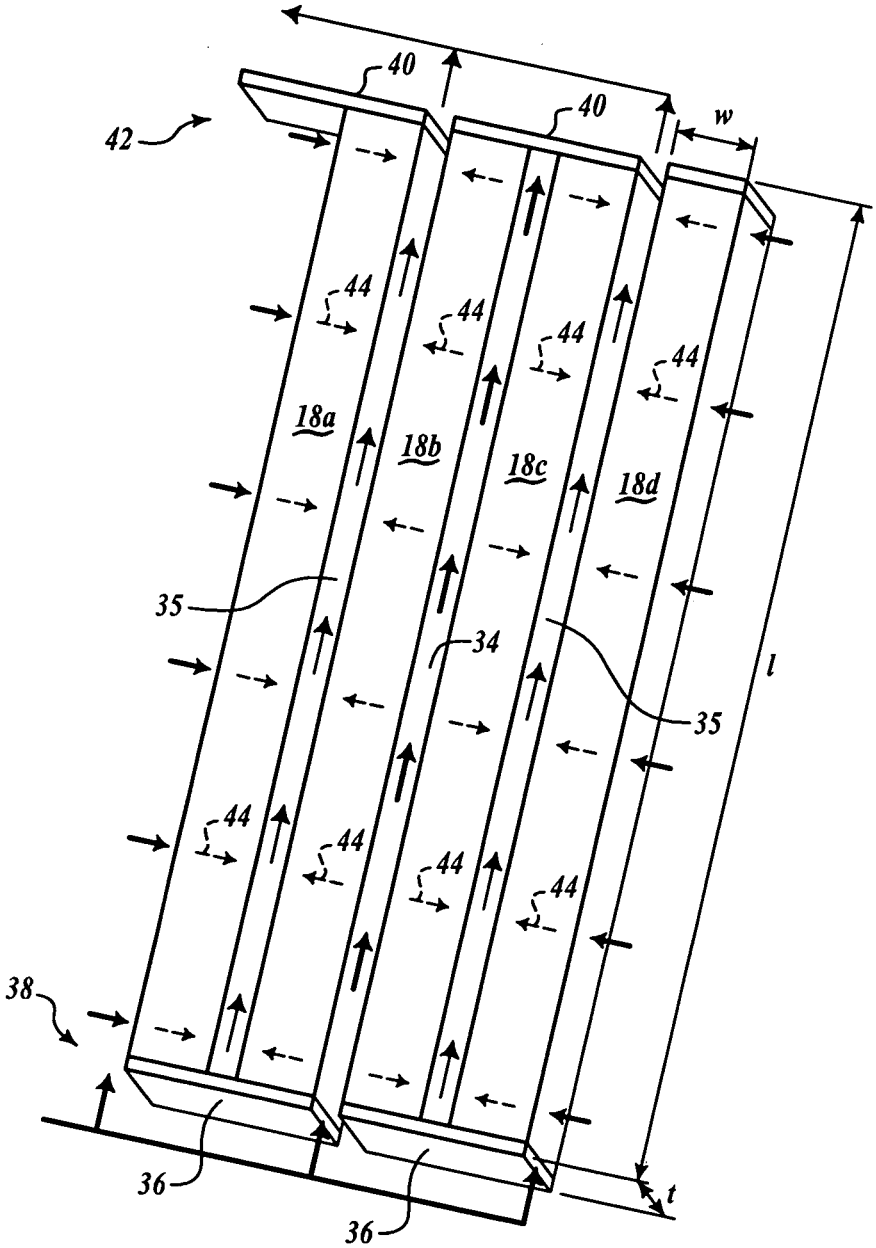
FIG. 1C illustrates details of features of the exemplary ceramic foam cold plate of FIGS. 1A and 1B.

Referring additionally to FIG. 1C, the foam strips 18 transfer heat to the coolant that flows through the foam strips 18. The foam strips 18 may have any dimensions as desired for a particular application. Given by way of non-limiting example, the foam strips 18 may have a length l of approximately around one-and-a-half feet. In one exemplary embodiment, the length l is on the order of around 17 inches. The foam strips 18 may have a thickness t on the order of less than approximately one inch. In one exemplary embodiment, the thickness t is on the order of around one fourth of an inch. The foam strips 18 may have a width w on the order of less than one inch or so. In one exemplary embodiment, the width w is on the order of around one fourth of an inch. Because the coolant flows through the foam strips 18 through the width w, the width w represents the cooling length—that is, the length the coolant flows through the foam strips 18 during which the majority of heat is transferred to the coolant. Additional heat may be transferred to the coolant as the coolant scrubs the top cover plate 20 and bottom cover plate 22 as it flows through the outlet plenums 35 towards the outlet port 16.

The foam strips 18 are arranged within the housing 12 in such a manner as to create several inlet plenums 34 and outlet plenums 35. The inlet plenums 34 and the outlet plenums 35 provide several channels for coolant to flow into and out of the several foam strips 18, respectively, thereby advantageously helping to reduce pressure drop across the cold plate 10. In an exemplary embodiment, the pressure drop across the cold plate 10 is merely on the order of inches of water when air is used as the coolant. As shown in FIG. 1C, an end cap 36 is attached to adjacent foam strips 18*a* and 18*b* at an end 38 of the foam strips 18. An end cap 36 is also attached to adjacent foam strips 18*c* and 18*d* at the end 38. An end cap 40 is attached to the foam strip 18*a* (but not the foam strip 18*b*) at an end 42 of the foam strips 18. An end cap 40 is also attached to the adjacent foam strips 18*b* and 18*c* at the end 42. Finally, an end cap 40 is attached to the foam strip 18*d* at the end 42.

The coolant flows from the inlet port 14 toward the foam strips 18. The flow of the coolant is blocked by the end caps 36. Therefore, the coolant is channeled into the inlet plenums 34. The end cap 40 prevents the coolant from exiting the inlet plenum 34. Therefore, the coolant is forced through the width w of the foam strips 18 as indicated by arrows 44. After the coolant has flowed through the width w of the foam strips 18, the coolant exits the foam strips 18 into the outlet plenums 35. The end caps 36 prevent the coolant from exiting the outlet plenums 35. Therefore, the coolant exits the outlet plenums 35 to the outlet port 16, from which the coolant is discharged from the cold plate 10.

Advantageously, the foam strips 18 are made of material that has a small pore size as well as high porosity. The pore size suitably is on the order of no more than around 50 micrometers or so. Given by way of non-limiting example, in one exemplary embodiment the pore size is on the order of around 35 micrometers. The material is also suitably hyperporous. To that end, porosity is on the order of at least around 80 percent or so. Given by way of a non-limiting example, in one exemplary embodiment porosity is on the order of around 90 percent.

A small pore size as described above greatly increases internal surface area-to-volume ratio, or surface area density, of the material of the foam strips 18. Therefore, this surface area-to-volume ratio greatly increases heat transfer capability of the foam strips 18. Because the pore size of the material of the foam strips 18 is more than an order of magnitude smaller than pore size of materials currently used in conventional metal foam cold plates, the internal surface area-to-volume ratio of the foam strips 18 is more than an order of magnitude greater than that for currently known metal foam cold plates—even though porosity may be comparable. As a result, the heat transfer area internal to the foam strips 18 advantageously is more than an order of magnitude greater than that for materials used in currently known metal foam cold plates.

Advantageously, use of the several foam strips 18 and the several inlet plenums 34 and outlet plenums 35 overcomes the higher coolant pressure loss associated with small pore sizes. Pressure losses associated with the foam strips 18 advantageously are mitigated by minimizing the cooling length—that is, the width w of the foam strips 18—while maximizing the number of the foam strips 18 and/or their length l. Thus, the cold plate 10 takes advantage of the small pore size of the foam strips 18 that greatly increase internal heat transfer surface area while overcoming the higher pressure loss related to small pore sizes. As a result, pressure drop across the cold plate 10 is comparable to pressure drop across currently known metal foam or finned cold plates.

Therefore, in contrast to conventional cold plates, the cold plate 10 advantageously reduces the amount of cooling air required to cool contemporary avionics. This, in turn, reduces the avionics cooling penalty for an air vehicle, thereby increasing vehicle thrust and/or lowering fuel consumption. Alternately, a smaller ECS can be used, thereby reducing weight and fuel burn. In addition, the cold plate 10 advantageously can address the cooling of future high power electronics. These chips are projected to generate significantly more heat than contemporary chips while maintaining an operating temperature limit of approximately 160° F. The cold plate 10 could cool these chips using the same amount of air that currently known cold plates use for lower power contemporary chips. This would then preclude the need for using more complicated and heavier liquid cooling systems.

Figure 2:
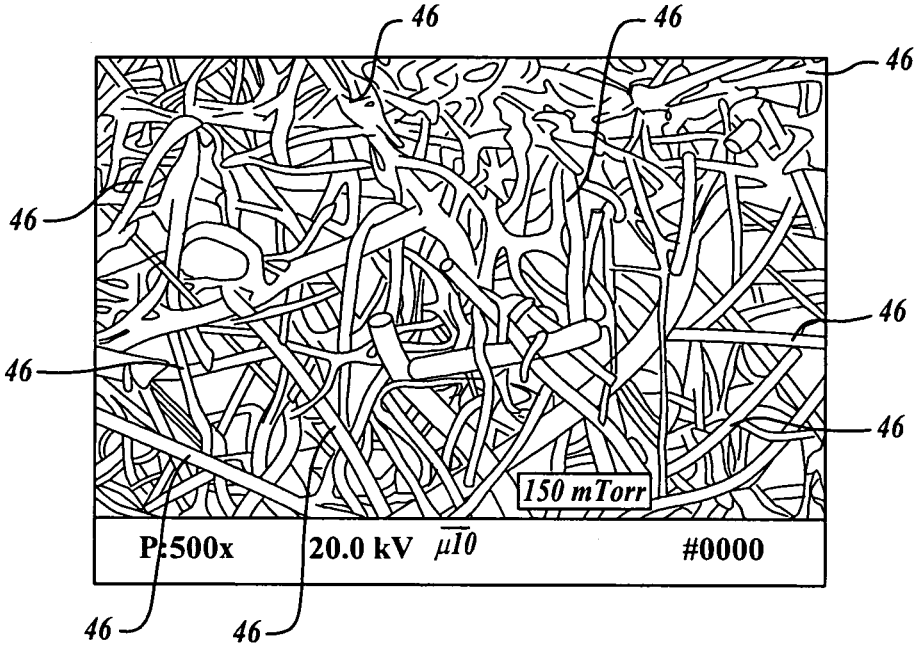
FIG. 2 illustrates pore size of exemplary ceramic foam.

The foam strips 18 may be made of any acceptable material that combines small pore size and hyperporosity as described above. Given by way of non-limiting example, ceramic foam suitably is used as the material for the foam strips 18. In one exemplary and non-limiting embodiment, a ceramic foam that is especially well-suited for the foam strips 18 is a hyperporous, microchannel (that is, small pore size on the order of around 35 micrometers) alumina silica ceramic foam that includes up to around 68 percent silica, around 20 percent alumina, and around 12 percent alumina borosilicate fibers. One example of such an exemplary ceramic foam is Alumina Enhanced Thermal Barrier (AETB), made by The Boeing Company, Huntington Beach, Calif. FIG. 2 illustrates an electron micrograph of fibers 46 of AETB, indicating a pore size on the order of around 35 micrometers.

Figure 3A:
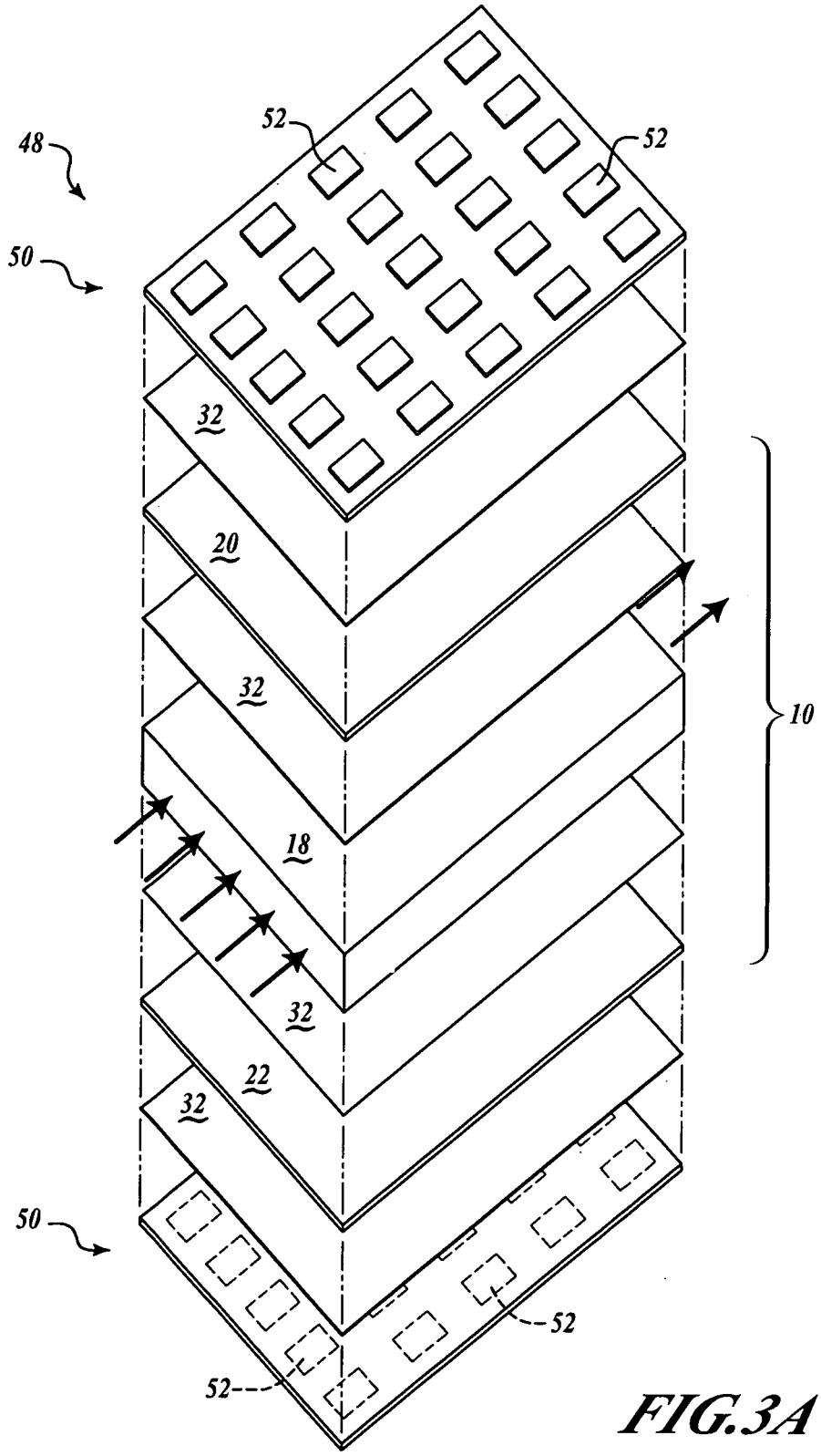
FIGS. 3A and 3B are perspective views of exemplary circuit board assemblies cooled with a cold plate.
Figure 3B:
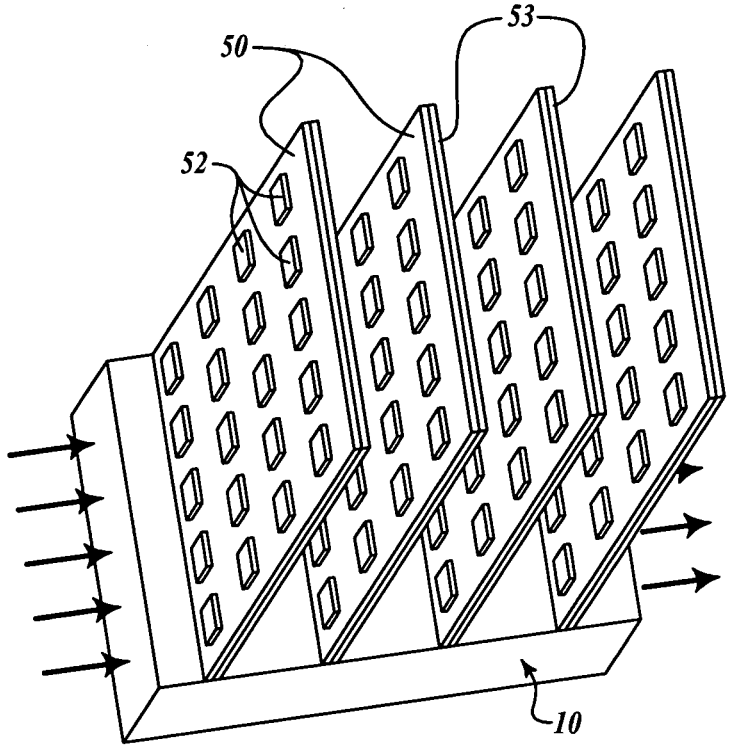

The cold plate 10 is especially well-suited for cooling circuit board assemblies. Referring now to FIG. 3A, a circuit board assembly 48 includes at least one printed circuit board 50 having first and second sides. Printed circuits 52 are mounted on the first side of the printed circuit board 50. The second side of the printed circuit board 50 is bonded to the top cover plate 20 (for one of the printed circuit boards 50) or the bottom cover plate 22 (for the other printed circuit board 50) using the thermal sealant 32. Referring now to FIG. 3B, in another exemplary arrangement the cold plate 10 is well suited for cooling multiple printed circuit boards 50. The printed circuit boards 50 are mounted to heat spreaders 53. Heat dissipated to the heat spreaders 53 is conducted to the cold plate 10 since the heat spreaders 53 are in thermal contact with the cold plate 10.

The advantageous heat transfer characteristics and flow properties of the cold plate 10 and the foam strips 18 (FIGS. 1A-1C) have been validated during testing. The internal convective heat transfer coefficient, denoted as h, that corresponds to a nominal set of test conditions from an AETB ceramic foam cold plate test was quantified by a heat transfer analysis. The internal convective heat transfer coefficient needed to achieve an average top cover plate temperature and bottom cover plate temperature of 122° F. was determined for AETB foam and a conventional metal foam DUOCEL. AETB ceramic foam with a porosity of 0.9 and an average pore size of 35 micrometers has a thermal conductivity of 0.05 BTH/hr-ft-degree R and an internal surface area-to-volume ratio of 31,350 $ft^2/ft^3$. Conversely, DUOCEL metal foam with a porosity of 0.9 and an average pore size of 508 micrometers has a thermal conductivity of 5.6 BTH/hr-ft-degree R and an internal surface area-to-volume ratio of only 860 $ft^2/ft^3$. The internal convective heat transfer coefficient was determined according to the relationship $$Q=h_{conv}A(122°\ F.-70°\ F.) \quad (1)$$

where Q=177 W; and $T_{top\ and\ bottom\ cover\ plates}$=122° F.

$T_{Coolant}$=70° F.

The results of the analysis are shown below in Table 1.

TABLE 1

| Foam Thickness (in) | $A_{DUOCEL}/A_{AETB}$ | $h_{DUOCEL}/h_{AETB}$ |
|---|---|---|
| 0.25 | 0.03 | 11.5 |
| 0.75 | 0.03 | 4.2 |

The high internal surface area of the AETB ceramic foam more than offsets its low thermal conductivity. The h value needed for the DUOCEL metal foam was 11.5 times greater than that needed for the AETB ceramic foam. A higher coolant flow rate is needed to produce a higher h value. Therefore, a significantly higher coolant flow rate would be required for a DUOCEL metal foam cold plate compared to the cold plate 10. Thus, the cold plate 10 provides superior avionic cooling performance compared to a metal foam cold plate, because the lower coolant flow rate translates into a lower air vehicle penalty.

Testing was also performed on a conventional back side convection avionics cold plate for comparison to an AETB ceramic foam cold plate. The AETB ceramic foam cold plate used a continuous piece of foam instead of foam strips. Aluminum plates were bonded to both sides of the AETB cold plate to allow attachment of conduction heaters for simulating the avionics PCB heat load (158 W Total). The conventional cold plate was a high aspect ratio duct through which coolant was passed. Conduction heaters were also bonded to both sides of the conventional cold plate to simulate the avionics load (158 W Total). Testing was done with a single upstream plenum feeding one end of the cold plate and a single coolant outlet. Both the conventional cold plate and AETB cold plate were 0.25 inches thick and had a cooling flow length of 6 inches.

Results from the testing showed that to maintain an average cold plate temperature of 115° F., the conventional cold plate needed 3 lb/min of cooling air compared to only 1 lb/min for the AETB cold plate. The AETB cold plate lowered the required coolant flow rate by a factor of 3. This represents a significant reduction in the air vehicle system penalty associated with the ECS. If strips of AETB ceramic foam had been utilized in the test rather than a continuous piece of foam, the required flow rate would have been even further reduced. As described below, reducing the flow length reduces the required coolant pressure. For the flow rate tested, the velocity of cooling air flowing through a 0.25 inch flow length is approximately twice as high as the velocity of air flowing through a 6 inch flow length. Higher flow velocities equate to higher heat transfer.

The small pores found in the foam strips 10 cause rarefaction of the flow through the material which advantageously minimizes pressure drop. Rarefaction occurs because the flow channel size approaches the mean free path of the individual air molecules in the coolant flow. This means that the flow can no longer be considered as a continuum and instead must be considered in terms of the path of individual particles through a channel. Rarefaction ultimately results in a non-zero "slip" velocity at the walls bounding a channel and an attendant reduction in pressure drop for the flow, compared to what would be expected for continuum flow and a no-slip boundary. This behavior was seen in testing of the cold plate 10, as shown in FIG. 4.

Figure 4:
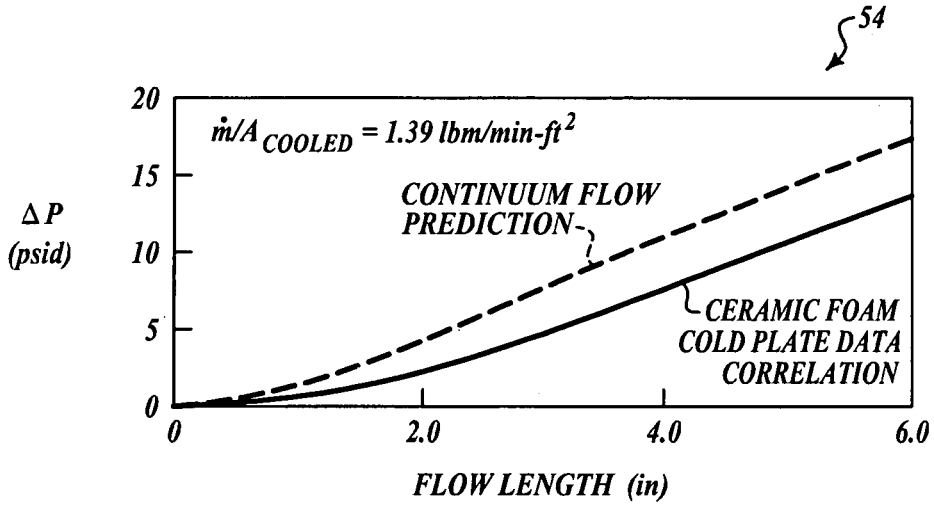
FIG. 4 is a graph of pressure drop versus flow length for an exemplary ceramic foam cold plate.

Referring now to FIG. 4, a graph 54 plots pressure drop versus flow length. The slip flow produced by rarefaction in the foam strip 18 reduces the pressure drop by 20 percent to 50 percent compared to what would be expected under the continuum flow assumption. The graph 54 also indicates that pressure drop for cooling lengths (that is, the width w of the foam strip 18) under approximately 1 inch are comparable to conventional cold plate pressure drop. This reduction in pressure drop due to small pore rarefaction along with the extremely high internal surface area already discussed work in concert to provide the cold plate 10 with convective heat transfer capabilities far superior to currently known metal foam or finned cold plates.

Figure 5A:
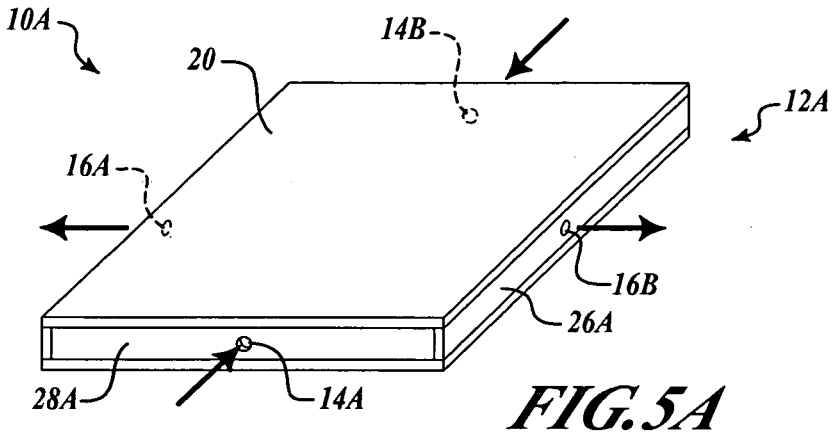
FIG. 5A is a perspective view of another exemplary ceramic foam cold plate.
Figure 5B:
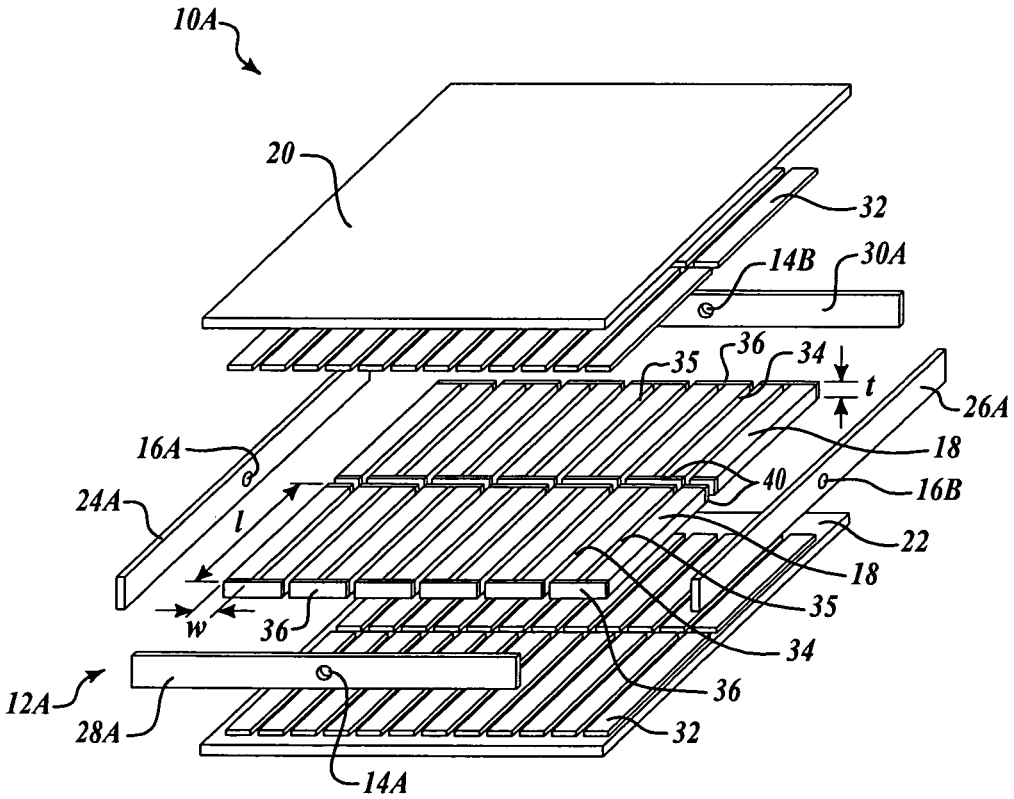
FIG. 5B is an exploded perspective view of the exemplary ceramic foam cold plate of FIG. 5A.

Referring now to FIGS. 5A and 5B, another exemplary cold plate 10A includes the foam strips 18. The cold plate 10A is well-suited for use in applications, such as heat exchangers, that entail larger heat transfer surface areas than do printed circuit boards. Thus, the cold plate 10A may also be referred to as a heat exchanger plate. Cooling air is introduced on each end of the cold plate 10A to maximize cooling efficiency by minimizing the temperature rise experienced by the cold plate 10A. To that end, a housing 12A defines inlet ports 14A and 14B and outlet ports 16A and 16B, and two pluralities of the foam strips 18 are disposed in the housing 12A. The foam strips 18 have been discussed in detail above. The pluralities of foam strips 18 are arranged within the housing 12A such that coolant flows through a width w of the foam strips 18 as discussed above in connection with FIG. 1C.

Still referring to FIGS. 5A and 5B, the housing 12A is made of the top and bottom cover plates 20 and 22, side plates 24A and 26A, and end plates 28A and 30A. The end plate 28A defines the inlet port 14A and the end plate 30A defines the inlet port 14B for receiving the coolant as described above. The side plate 24A defines the outlet port 16A and the side plate 26A defines the outlet port 16B for discharging the coolant from the cold plate 10A. The thermal sealant 32 physically connects the top cover plate 20 with the foam strips 18 and the bottom cover plate 22 with the foam strips 18.

In the same manner as described above in connection with FIG. 1C, the end caps 36 are attached to ends of the foam strips 18 near the inlet ports 14A and 14B and the end caps 40 are attached to the other ends of the foam strips 18. Thus, coolant flows into the inlet ports 14A and 14B, is channeled into the inlet plenums 34, flows through the widths of the foam strips 18, is channeled through the outlet plenums 35, meets in the mid-plane of the cold plate 10A, splits, and is discharged from the cold plate 10A via the outlet ports 16A and 16B.

Figure 6:
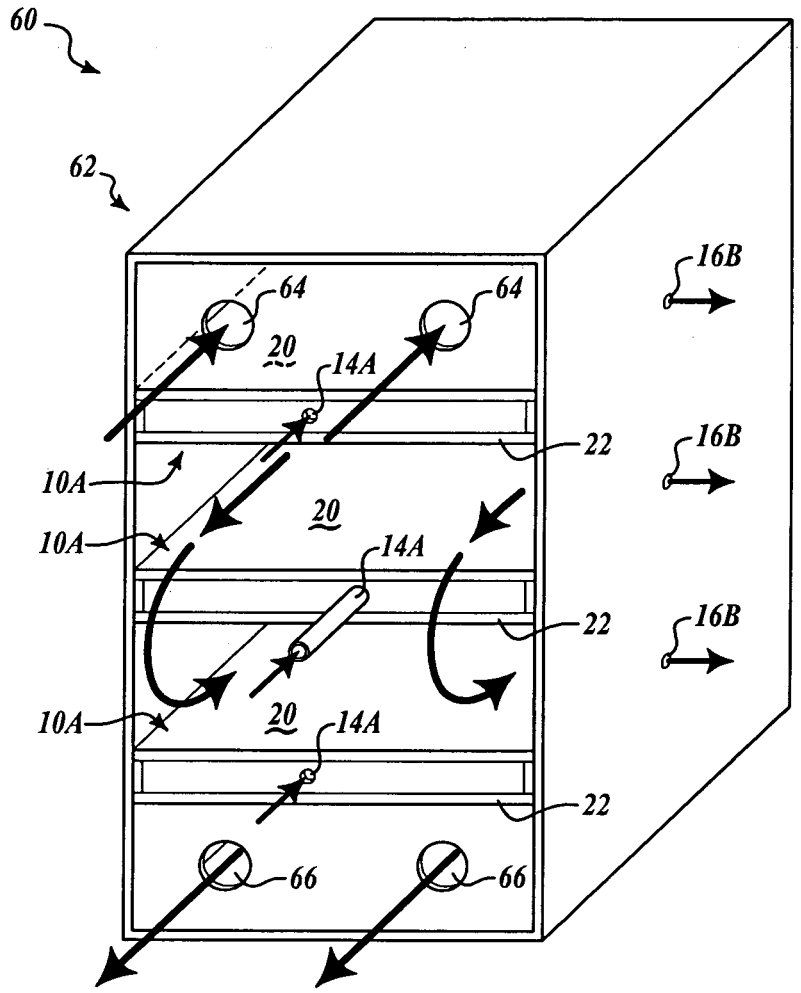
FIG. 6 is a perspective view in partial schematic form of an exemplary heat exchanger.

Referring now to FIG. 6, the cold plate 10A is especially well-suited for use as a heat exchanger plate in an exemplary heat exchanger 60. However, the cold plate 10 (FIGS. 1A-1C) may also be used as a heat exchanger plate in the heat exchanger 60, depending upon the cooling requirements placed upon the heat exchanger 60.

The heat exchanger 60 is a multiple pass heat exchanger. In an exemplary, non-limiting application, the heat exchanger 60 may use ram air from outside an aircraft to cool the air used for avionics cooling. Other aerospace applications for the heat exchanger 60 may include cooling engine oil/fuel and condensing ECS refrigerant. A heat exchanger housing 62 defines inlet ports 64 for receiving the fluid needing cooling, and outlet ports 66 for discharging the cooled fluid. The heat exchanger plates 10A are mounted within the housing 62 between the inlet ports 64 and the outlet ports 66 so the fluid needing cooling flows directly over the top cover plate 20 and the bottom cover plate 22 of the heat exchanger plates 10A mounted within the housing 62. Heat from the fluid entering the inlet ports 64 of the heat exchanger plates 10A is transferred to the coolant (or fluid) which enters the heat exchanger plate via inlet port 14A. The heated coolant (or fluid) is discharged from the heat exchanger plates 10A via the outlet ports 16B. As a result of the superior cooling capabilities of the heat exchanger plates 10A, the heat exchanger 60 can provide the same amount of cooling as conventional heat exchangers but at greatly reduced system penalties. This is because the heat exchanger 60 could be more compact and lighter weight than conventional heat exchangers.

Figure 7:
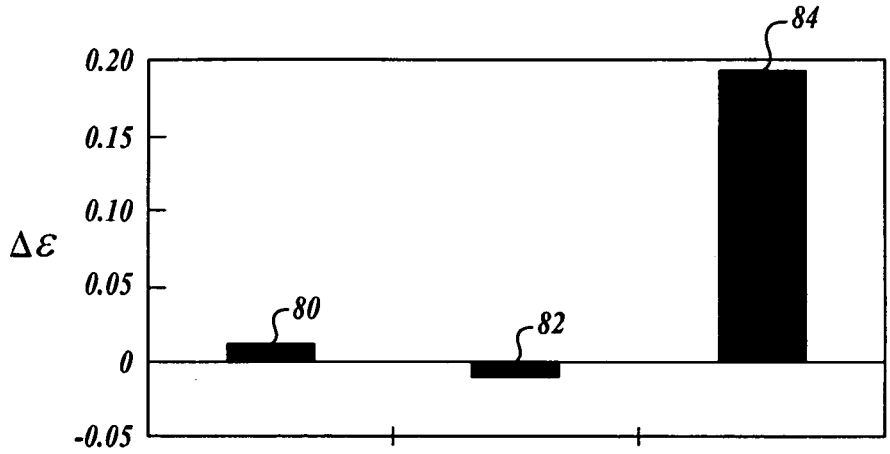
FIG. 7 plots thermal effectiveness for ceramic foam of various configurations and thicknesses.

Testing has also determined that low thermal conductivity of the AETB ceramic foam can be mitigated further by decreasing thickness of strips made of the ceramic foam material used in a cold plate. Referring now to FIG. 7, thermal (cold plate cooling) effectiveness is plotted for various thicknesses of AETB ceramic foam in various configurations having a six-inch length. Testing was performed with an incident flux of 0.65 W/cm$^2$ and a coolant flow rate of 0.04 lbm/min. A reference level of thermal effectiveness (0.00 on the y-axis) is thermal effectiveness of an aluminum foam cold plate. A bar graph 80 of thermal effectiveness for solid 0.25 inch thick AETB ceramic foam and a bar graph 82 of thermal effectiveness for 0.25 inch thick strip AETB ceramic foam arranged in a strip plenum (as shown in FIG. 1B) are both indicative of substantially the same thermal effectiveness as the reference thermal effectiveness. A bar graph 84 of thermal effectiveness for 0.055 inch thick strip AETB ceramic foam (arranged in a strip plenum, as shown in FIG. 1B) is indicative of a significantly higher thermal effectiveness—nearly twenty percent higher—than that of the reference thermal effectiveness.

Figure 8:
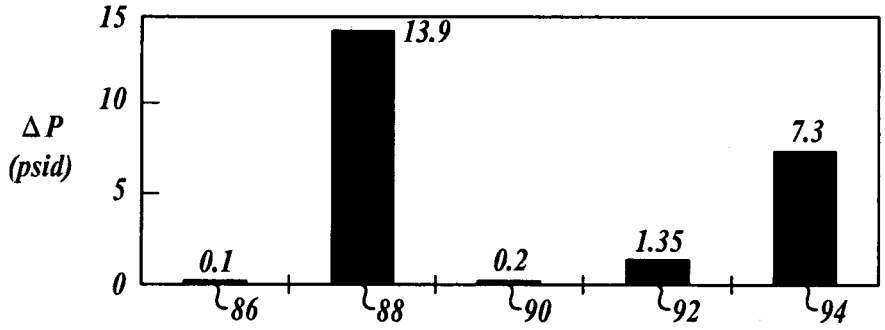
FIG. 8 plots pressure drop for various materials.

However, testing also determined that reducing thickness of the AETB ceramic foam strip increases pressure drop in inlet and outlet plenum channels in ceramic foam cold plates with multiple plenums, such as the cold plate 10 (FIG. 1B.). Referring now to FIG. 8, pressure drop (in psid) is plotted for various thicknesses of foams in various configurations having a six-inch length. Testing was performed with a conduction heater flux of 0.2 W/cm$^2$ and a coolant flow rate of 0.04 lbm/min. A bar graph 86 shows a reference pressure drop of 0.1 psid for an aluminum foam cold plate. A bar graph 88 shows a pressure drop of 13.9 psid for solid 0.25 inch thick AETB ceramic foam. A bar graph 90 shows a pressure drop of 0.2 psid (approximately the reference pressure drop) for 0.25 inch thick AETB ceramic foam strips arranged in a strip plenum (as shown in FIG. 1B). A bar graph 92 shows a pressure drop of 1.3 psid for 0.125 inch thick AETB ceramic foam strips arranged in a strip plenum (as shown in FIG. 1B). A bar graph 94 shows a pressure drop of 7.3 psid for 0.055 inch thick AETB ceramic foam strips arranged in a strip plenum (as shown in FIG. 1B).

It will be appreciated from FIG. 8 that the 0.25 inch thick AETB ceramic foam strips arranged in a strip plenum (shown by the bar graph 90) has a pressure drop comparable to the reference aluminum foam cold plate. It will also be appreciated from FIG. 8 that reducing the thickness of AETB ceramic foam arranged in a strip plenum to 0.055 inches (shown by the bar graph 94) increases the pressure drop to about half of that for a solid 0.25 inch thick AETB ceramic foam cold plate (shown by the bar graph 88).

Figure 9:
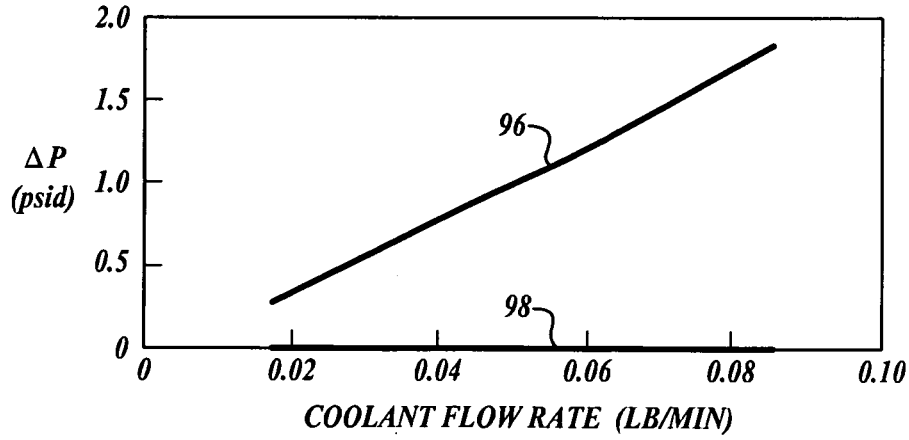
FIG. 9 plots pressure drop versus coolant flow rate.
Figure 10A:
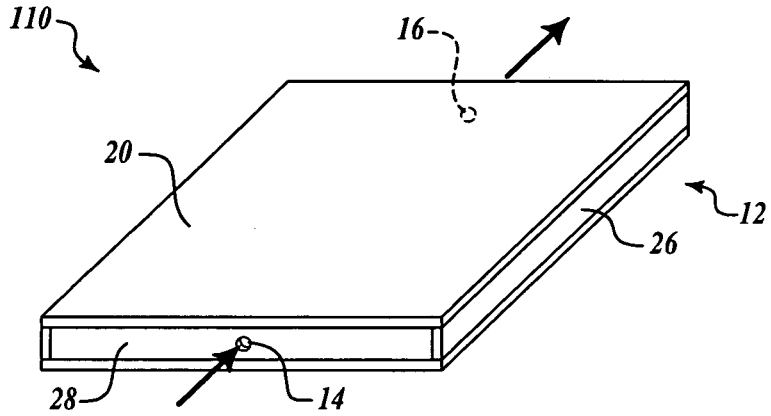
FIG. 10A is a perspective view of an exemplary hybrid ceramic foam cold plate.
Figure 10B:
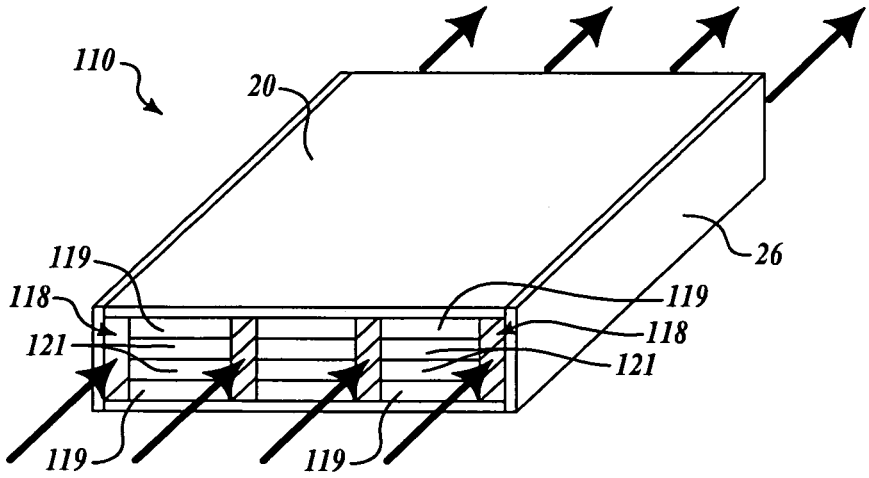
FIG. 10B is a perspective view of components of the exemplary hybrid ceramic foam cold plate of FIG. 10A.
Figure 10C:
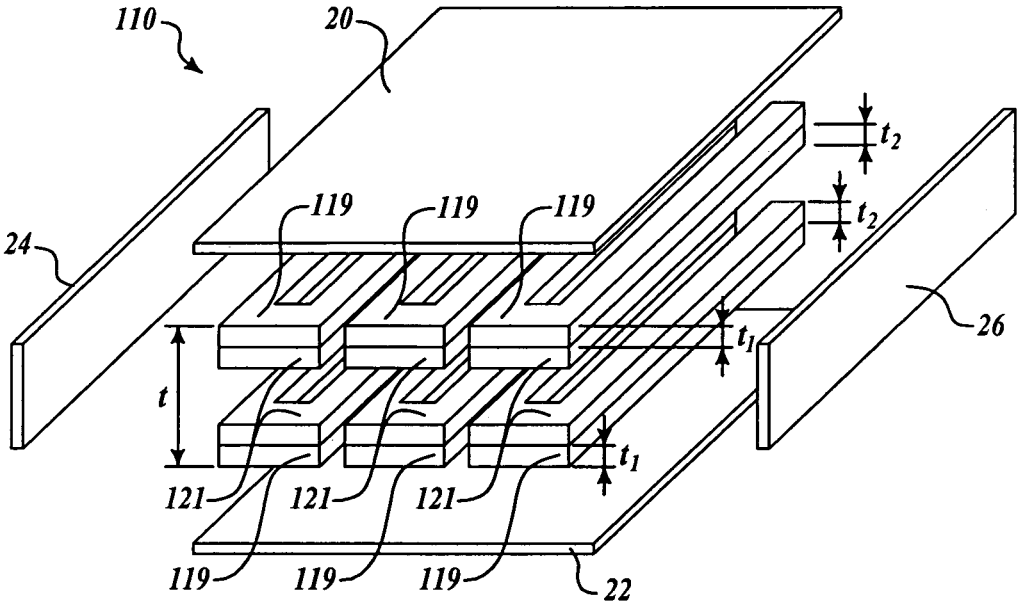
FIG. 10C is an exploded perspective view of the components of FIG. 10B.
Figure 10D:
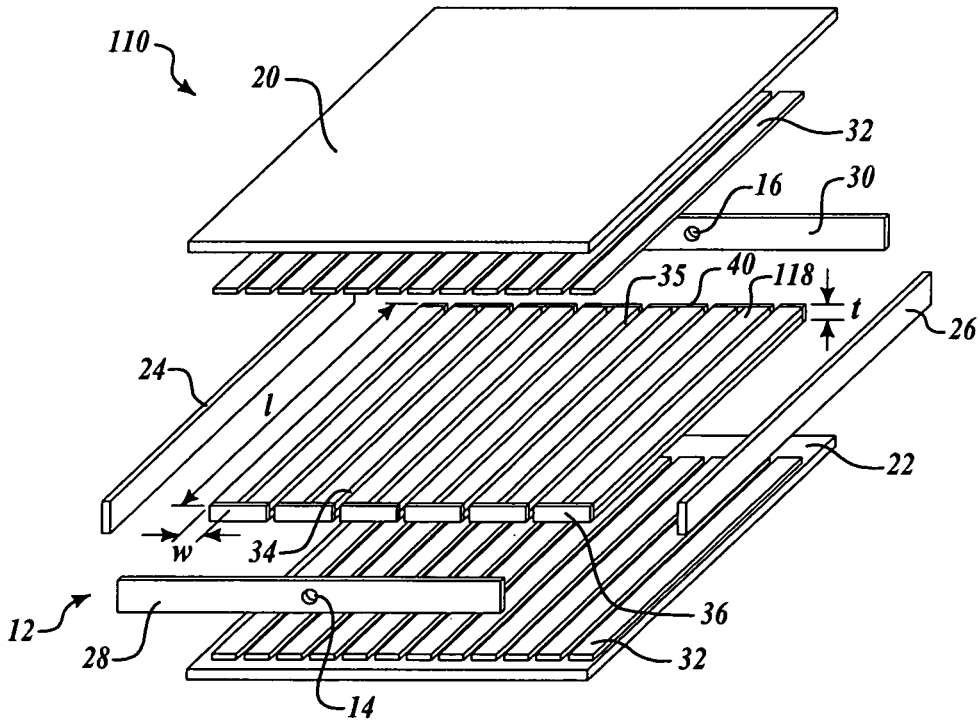
FIG. 10D is an exploded perspective view of the exemplary hybrid ceramic foam cold plate of FIG. 10A.
Figure 10E:
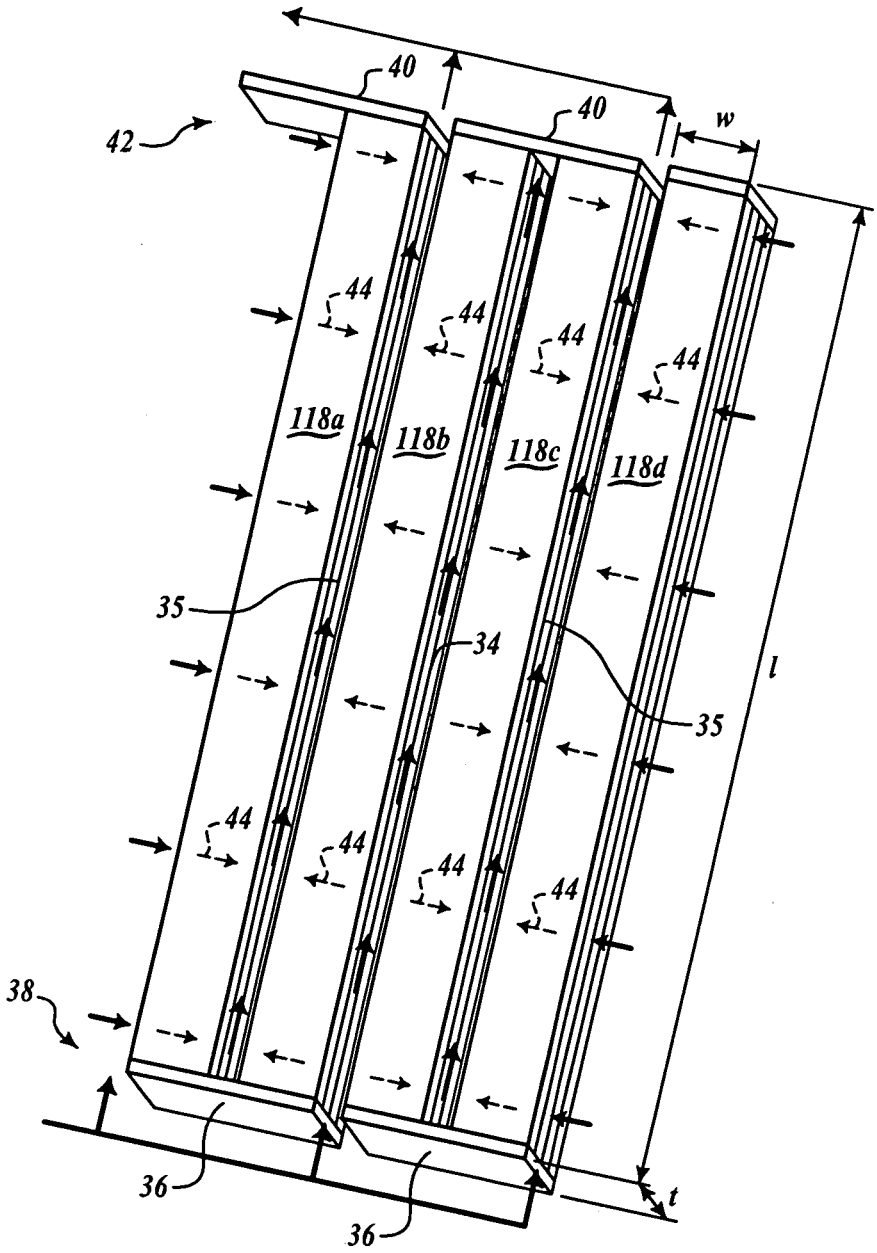
FIG. 10E illustrates details of features of the exemplary hybrid ceramic foam cold plate of FIGS. 10A through 10D.

The pressure drop increases with decreasing thicknesses of strips of AETB ceramic foam in strip plenum arrangements because the pressure drop is increasing in the inlet and outlet channels supplying the foam strips. Referring now to FIG. 9, a curve 96 plots measured pressure drop (in psia) across a cold plate that includes 0.055 inch thick strip AETB ceramic foam arranged in a strip plenum as a function of coolant flow rate (in lbm/min). As also shown in FIG. 9, a curve 98 plots pressure drop through the 0.055 inch thick strip AETB ceramic foam strips themselves. The curve 98 was estimated from pressure data taken on a single 0.055 inch thick strip of AETB ceramic foam with a 0.25 inch flow length. It will be appreciated that the difference between the two curves is the pressure drop in the inlet and outlet channels. This pressure drop is relatively high because reducing the cold plate thickness has reduced the flow area, thereby increasing the channel velocities. Thus, a vast majority of the measured pressure drop for a cold plate that includes 0.055 inch thick strip AETB ceramic foam strips arranged in multiple strip plenums is due to inlet and outlet channel restrictions and not the ceramic foam itself.

To that end and referring now to FIGS. 10A-10E, in another exemplary embodiment a cold plate 110 employs a high conductivity spacer 121 between thin strips of ceramic foam members 119 in ceramic foam strip assemblies 118. Such a hybrid design reduces the inlet and outlet channel pressure drop by increasing coolant flow area and decreasing coolant flow velocity, while maintaining high cooling effectiveness associated with use of thin ceramic foam strips. All other details of the cold plate 110 are the same as those for the cold plate 10 (FIGS. 1A-1C), and like reference numbers are used to refer to similar components. Repetition of previously explained details is not necessary for understanding of the cold plate 110.

In an exemplary embodiment, each ceramic foam strip assembly 118 includes two ceramic foam strip members 119 and two spacer members 121. Each spacer member 121 is attached to its associated ceramic foam strip member 119. The spacer members 121 are in turn attached to each other. The ceramic foam members 121 are physically attached to the top and bottom cover plates 20 and 22 as explained above. In another exemplary embodiment (not shown), one spacer member 121 may be inserted between two of the ceramic foam strip members 119, if desired. In another exemplary embodiment (not shown), more than two of the ceramic foam strip members 119 may be included in the ceramic foam strip assembly 118. That is, any number of the ceramic foam strip members 119 may be used as desired for a particular application. Moreover, the ceramic foam strip members 119 may be separated by any number of the spacer members 121 as desired for a particular application. Regardless of the number of ceramic foam strip members 119 and spacer members 121 that are used to make up a ceramic foam strip assembly 118, ceramic foam strip members 119 (as opposed to spacer members 121) are positioned as exterior members of the ceramic foam strip assembly 118. This arrangement is used because the ceramic foam strip members 119 (as opposed to the spacer members 121) are attached to the top and bottom cover plates 20 and 22.

Regardless of the number of ceramic foam strip members 119 and spacer members 121 used to make up the ceramic foam strip assembly 118, total thickness t of the ceramic foam strip assembly 118 is maintained at about the same thickness t of the ceramic foam strips 18 (FIGS. 1B, 1C, 3A, and 5B). As discussed above, a total thickness t for the ceramic foam strip assembly 118 comparable to thickness t of the ceramic foam strip 18 yields a pressure drop comparable to that associated with the ceramic foam strip 18 while still achieving the improved cooling performance associated with the thinner ceramic foam strip members 119. In an exemplary, non-limiting embodiment, the total thickness t of the ceramic foam strip assembly 118 is around 0.25 inches. It will be noted that 0.25 inches is an industry standard thickness for cold plates. However, the thickness t of the ceramic foam strip assembly 118 may be any thickness as desired for a particular application.

The ceramic foam strip members 119 suitably are made of the same ceramic foam material as the foam strips 18 (FIGS. 1B, 1C, 3A, and 5B)—that is, ceramic foam having properties like those of AETB ceramic foam. As discussed above, the ceramic foam strip members 119 are suitably thin in order to increase cooling effectiveness. In one exemplary, non-limiting embodiment in which two of the ceramic foam strip members 119 are used in a ceramic foam strip assembly 118, each of the ceramic foam strip members 119 may have a thickness $t_1$ on the order of around 0.03 inches. However, the ceramic foam strip members 119 may have any thickness $t_1$ (that is thinner than thickness t of the foam strips 18) as desired for a particular application.

The spacer member 121 suitably may be made from a thermally conductive material. For example, the spacer member 121 may be made from a high conductivity metal such as aluminum or copper or the like. Alternately, the spacer member 121 may be made from a low thermal conductivity material such as a polymer or plastic or the like. It will be appreciated that use of a high conductivity material for the spacer member 121 can produce a more uniform temperature over the surface of the cold plate 110 than could be achieved by use of a monolithic piece of ceramic foam for the strips.

The spacer member 121 suitably has a thickness $t_2$ that is selected to cooperate with the thickness $t_1$ of the ceramic foam strip members 119 such that total thickness t of the ceramic foam strip assembly 118 is maintained at about the same thickness t of the ceramic foam strips 18 (FIGS. 1B, 1C, 3A, and 5B). Given by way of non-limiting example, when two of the ceramic foam strip members 119 are used in a ceramic foam strip assembly 118 and each of the ceramic foam strip members 119 has a thickness $t_1$ of around 0.03 inches, each of the spacer members 121 (in embodiments with two spacer members 121) has a thickness $t_2$ of around 0.095 inches, thereby maintaining a total thickness t of the ceramic foam strip assembly 118 of around 0.25 inches. Alternately in embodiments (not shown) in which two of the ceramic foam strip members 119 are used and only one spacer member 121 is inserted between the ceramic foam strip members 119, when the ceramic foam strip members 119 each have a thickness $t_1$ of around 0.03 inches, the spacer member 121 has a thickness of around 0.19 inches, thereby maintaining a total thickness t of the ceramic foam strip assembly 118 of around 0.25 inches.

Figure 11A:
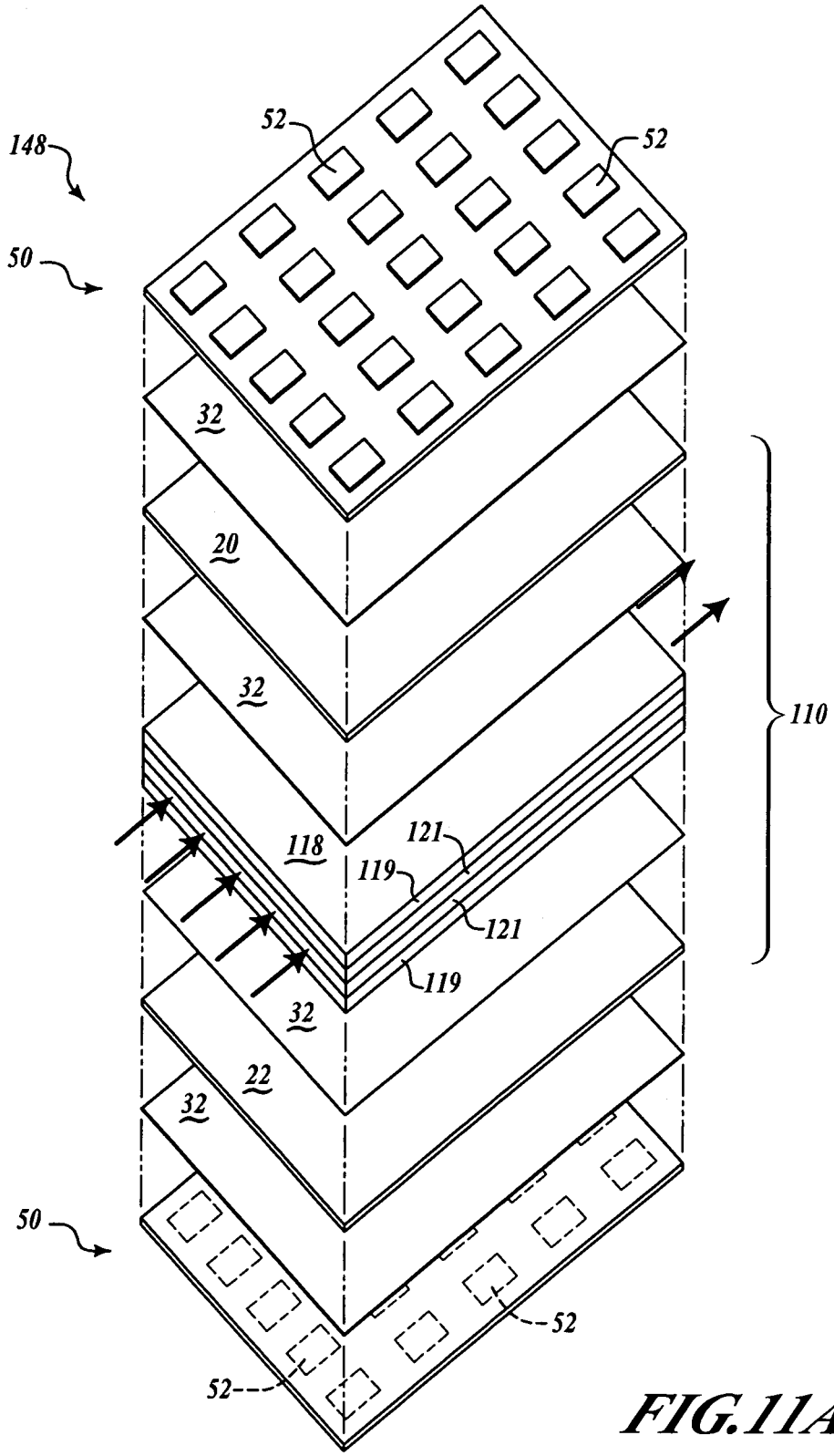
FIGS. 11A and 11B are perspective views of exemplary circuit board assemblies cooled with a hybrid ceramic foam cold plate.
Figure 11B:
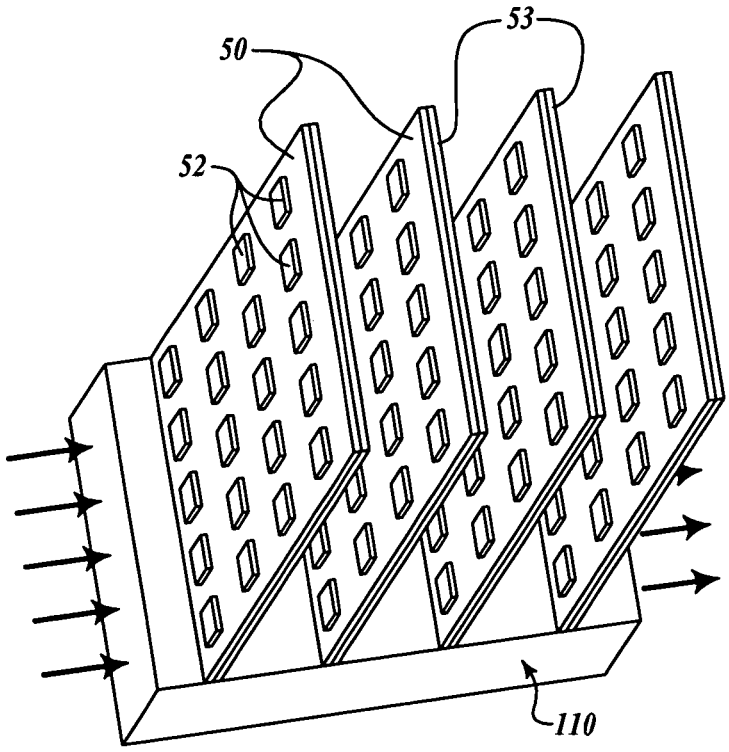

The cold plate 110 is especially well-suited for cooling circuit board assemblies. Referring now to FIG. 11A, a circuit board assembly 148 includes at least one printed circuit board 50 having first and second sides. Printed circuits 52 are mounted on the first side of the printed circuit board 50. The second side of the printed circuit board 50 is bonded to the top cover plate 20 (for one of the printed circuit boards 50) or the bottom cover plate 22 (for the other printed circuit board 50) using the thermal sealant 32. Referring now to FIG. 11B, in another exemplary arrangement the cold plate 110 is well suited for cooling multiple printed circuit boards 50. The printed circuit boards 50 are mounted to heat spreaders 53. Heat dissipated to the heat spreaders 53 is conducted to the cold plate 10 since the heat spreaders 53 are in thermal contact with the cold plate 10.

Figure 12A:
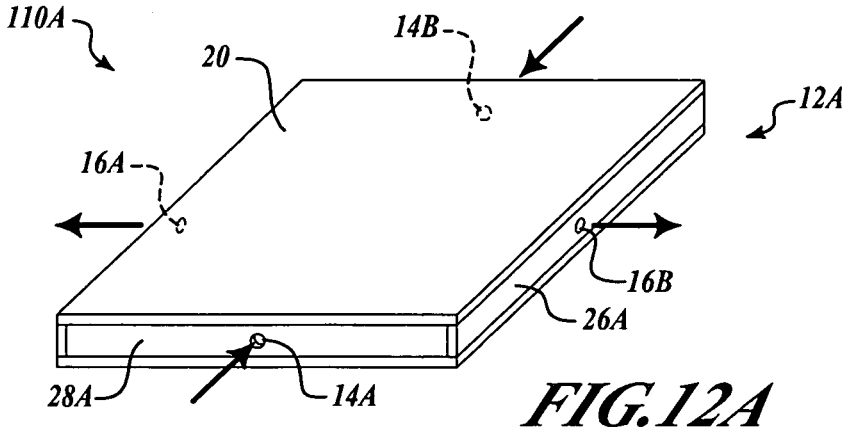
FIG. 12A is a perspective view of another exemplary hybrid ceramic foam cold plate.
Figure 12B:
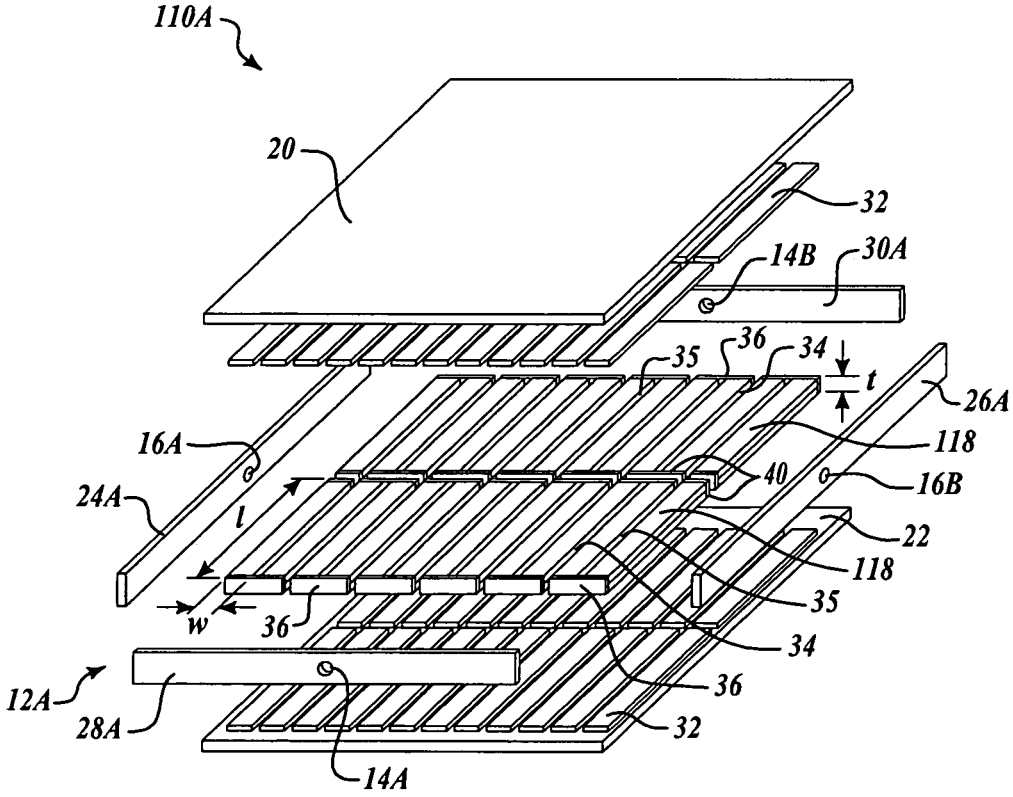
FIG. 12B is an exploded perspective view of the exemplary hybrid ceramic foam cold plate of FIG. 12A.

Referring now to FIGS. 12A and 12B, the ceramic foam strip assemblies 118 may be used in a cold plate 110A that is similar to the cold plate 10A (FIGS. 5A AND 5B). The cold plate 110A is well-suited for use in applications, such as heat exchangers, that entail larger heat transfer surface areas than do printed circuit boards. Thus, the cold plate 110A may also be referred to as a heat exchanger plate. Cooling air is introduced on each end of the cold plate 110A to maximize cooling efficiency by minimizing the temperature rise experienced by the cold plate 110A. The cold plate 110A includes the ceramic foam strip assemblies 118A (instead of the ceramic foam strips 18 that are used in the cold plate 10A). Otherwise, all other details of the cold plate 110A are the same as those for the cold plate 10A (FIGS. 5A and 5B), and like reference numbers are used to refer to similar components. As such, a repetition of details is not necessary for an understanding.

Figure 13:
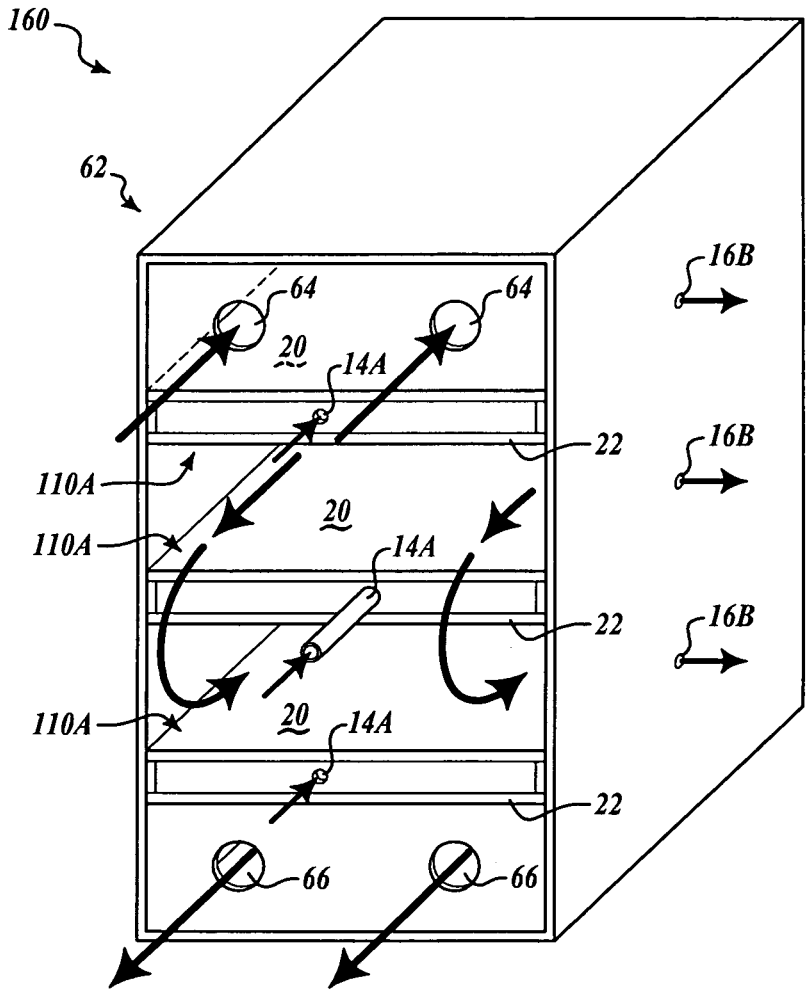
FIG. 13 is a perspective view in partial schematic form of another exemplary heat exchanger.

Referring now to FIG. 13, the cold plate 110A is especially well-suited for use as a heat exchanger plate in an exemplary heat exchanger 160. However, the cold plate 110 (FIGS. 10A-10D) may also be used as a heat exchanger plate in the heat exchanger 160, depending upon the cooling requirements placed upon the heat exchanger 160.

The heat exchanger 160 is a multiple pass heat exchanger that is similar to the heat exchanger 60 (FIG. 6), except that the heat exchanger 160 uses the cold plate 110A (or the cold plate 110, as desired) instead of the cold plate 10A or the cold plate 10. Otherwise, all other details of the heat exchanger 160 are the same as those for the heat exchanger 60 (FIG. 6), and like reference numbers are used to refer to similar components. As such, a repetition of details is not necessary for an understanding.

While a number of exemplary embodiments and aspects have been illustrated and discussed above, those of skill in the art will recognize certain modifications, permutations, additions, and sub-combinations thereof. It is therefore intended that the following appended claims and claims hereafter introduced are interpreted to include all such modifications, permutations, additions, and sub-combinations as are within their true spirit and scope.

What is claimed is:

1. A cold plate comprising:

a housing including a top plate and a bottom plate, the housing defining a first inlet port and a first outlet port;

a first plurality of foam strip assemblies disposed in the housing, each foam strip assembly of the first plurality of foam strip assemblies comprising a first foam strip that is coupled to the top plate and a first spacer coupled to a portion of the first foam strip that is opposite the top plate; and a second plurality of foam strip assemblies disposed in the housing, each foam strip assembly of the second plurality of foam strip assemblies comprising a second foam strip that is coupled to the bottom plate and to the first spacer of an adjacent first foam strip of the first plurality of foam strip assembies, wherein the first and second pluralities of foam strip assemblies are arranged within the housing to create a plurality of first inlet and a plurality of first outlet plenums configured, such that, when coolant is received at the first inlet port, the coolant from the first inlet port is forced from the plurality of first inlet plenums through widths of the foam strip assemblies in the first and second pluralities of foam strip assemblies into the plurality of first outlet plenums and into the first outlet port.

2. The cold plate of claim 1, wherein each of the second plurality of foam strip assemblies further includes a second spacer coupled to a portion of the second foam strip opposite the bottom plate and attached to the first spacer.

3. The cold plate of claim 1, wherein the first spacer includes a member formed of a thermally conductive material.

4. The cold plate of claim 3, wherein the thermally conductive material includes a metal.

5. The cold plate of claim 4, wherein the metal includes a metal chosen from copper and aluminum.

6. The cold plate of claim 3, wherein the first spacer includes a member formed of a polymer.

7. The cold plate of claim 1, wherein at least one foam strip of the first plurality of foam strip assemblies or of the second plurality of foam strip assemblies has a pore size of no more than 50 micrometers and a porosity of at least 80 percent.

8. The cold plate of claim 7, wherein the pore size is around 35 micrometers and the porosity is around ninety percent.

9. The cold plate of claim 7, wherein the foam includes ceramic foam.

10. A heat exchanger comprising:

a heat exchanger housing defining at least one heat exchanger inlet port for a first fluid and at least one heat exchanger outlet port for the first fluid; and at least one cold plate disposed within the heat exchanger housing between the heat exchanger inlet port and the heat exchanger outlet port such that the first fluid is flowable in thermal communication with the at least one cold plate, the at least one cold plate including:

a cold plate housing including a top plate and a bottom plate, the cold plate housing defining at least a first cold plate inlet port for a second fluid and at least a first cold plate outlet port for the second fluid;

a first plurality of foam strip assemblies disposed in the cold plate housing, each foam strip assembly of the first plurality of foam strip assemblies comprising a first foam strip that is coupled to the top plate and a first spacer coupled to a portion of the first foam strip that is opposite the top plate; and a second plurality of foam strip assemblies disposed in the cold plate housing, each foam strip assembly of the second plurality of foam strip assemblies comprising a second foam strip that is coupled to the bottom plate and to the first spacer of an adjacent first foam strip of the first plurality of foam strip assemblies;

wherein the first and second pluralities of foam strip assemblies are arranged within the cold plate housing to create a plurality of inlet plenums between a portion of adjacent first lengths of the first and second pluralities of foam strip assemblies and to create a plurality of outlet plenums between opposite first lengths of the first and second pluralities of foam strip assemblies, such that, when the second fluid is received at the first cold plate inlet, the second fluid is forced from the first cold plate inlet port into the plurality of inlet plenums through foam strips of the first and second pluralities of foam strip assemblies and into the plurality of outlet plenums and into the first cold plate outlet port.

11. The heat exchanger of claim 10, wherein each of the second plurality of foam strip assemblies further includes a second spacer coupled to a portion of the second foam strip that is opposite the bottom plate and attached to the first spacer.

12. The heat exchanger of claim 10, wherein the first spacer includes a member formed of a thermally conductive material.

13. The heat exchanger of claim 12, wherein the thermally conductive material includes a metal.

14. The heat exchanger of claim 13, wherein the metal includes a metal chosen from copper and aluminum.

15. The heat exchanger of claim 12, wherein the first spacer includes a member formed of a polymer.

16. The heat exchanger of claim 10, wherein at least one foam strip of the first plurality of foam strip assemblies or of the second plurality of foam strip assemblies has a pore size of no more than 50 micrometers and a porosity of at least 80 percent.

17. The heat exchanger of claim 16, wherein the pore size is around 35 micrometers and the porosity is around ninety percent.

18. The heat exchanger of claim 16, wherein the foam includes ceramic foam.

19. A cold plate comprising:

a housing including a top plate and a bottom plate, the housing defining first and second inlet ports and first and second outlet ports; and a first plurality of foam strip assemblies disposed in the housing, each foam strip assembly of the first plurality of foam strip assemblies comprising a first foam strip that is coupled to the top plate and a first spacer coupled to a portion of the first foam strip that is opposite the top plate; and a second plurality of foam strip assemblies disposed in the housing, each foam strip assembly of the second plurality of foam strip assemblies comprising a second foam strip that is coupled to the bottom plate and to the first spacer of an adjacent first foam strip of the first plurality of foam strip assemblies, wherein the first and second pluralities of foam strip assemblies are arranged within the housing to create a plurality of first inlet plenums, a plurality of first outlet plenums, a plurality of second inlet plenums, and a plurality of second outlet plenums configured such that, when coolant is received at the first inlet port, the coolant from the first inlet port is forced from the plurality of first inlet plenums through foam strip assemblies into the plurality of first outlet plenums and into the first outlet port and coolant from the second inlet port is forced into the plurality of second inlet plenums through foam strip assemblies into the plurality of second outlet plenums and into the second outlet port.

20. The heat exchanger of claim 10, wherein:

the cold plate housing further defines a second cold plate inlet port for the second fluid and a second cold plate outlet port for the second fluid.

* * * * *